United States Patent [19]

Pacifici et al.

[11] Patent Number: 4,500,039

[45] Date of Patent: Feb. 19, 1985

[54] APPARATUS FOR UNIFORMLY APPLYING EITHER LIQUID OR FOAM COMPOSITIONS TO A MOVING WEB

[75] Inventors: Joseph A. Pacifici, La Grange; Clifford A. Bryant, Dalton, both of Ga.

[73] Assignee: West Point Pepperell, Inc., West Point, Ga.

[21] Appl. No.: 435,602

[22] Filed: Oct. 20, 1982

[51] Int. Cl.[3] ..... B05C 5/02

[52] U.S. Cl. ..... 239/193; 68/205 R; 118/407; 118/DIG. 4

[58] Field of Search ..... 118/407, 324, DIG. 4; 239/193, 590.5, 597, 598; 68/205 R; 425/4 C, 817 C

[56] References Cited

U.S. PATENT DOCUMENTS 2,681,294 6/1954 Beguin .
3,155,540 11/1964 Loeffler et al. .
3,717,121 2/1973 Bruckbauer et al. ..... 118/324
4,165,211 8/1979 Ebeling et al. .
4,267,795 5/1981 Reba .
4,292,918 10/1981 Davis et al. .
4,398,665 8/1983 Bryant et al. ..... 239/193

FOREIGN PATENT DOCUMENTS 642835 9/1927 France .
431228 7/1935 United Kingdom ..... 118/DIG. 4

*Primary Examiner*—John P. McIntosh
*Attorney, Agent, or Firm*—Cushman, Darby & Cushman

[57] ABSTRACT

An elongated manifold is supplied with either foam or liquid under pressure through a plurality of inlet ports spaced along the manifold. The manifold contacts a curved blade along a line substantially parallel to, and below the elevation of, the crest of a horizontally disposed curved blade. The manifold is provided with outlet means above the line of contact whereby foam or liquid discharged from the manifold builds up behind the blade's crest until it overflows the crest to flow as a uniform film onto a web moving past an edge of the blade.

5 Claims, 4 Drawing Figures

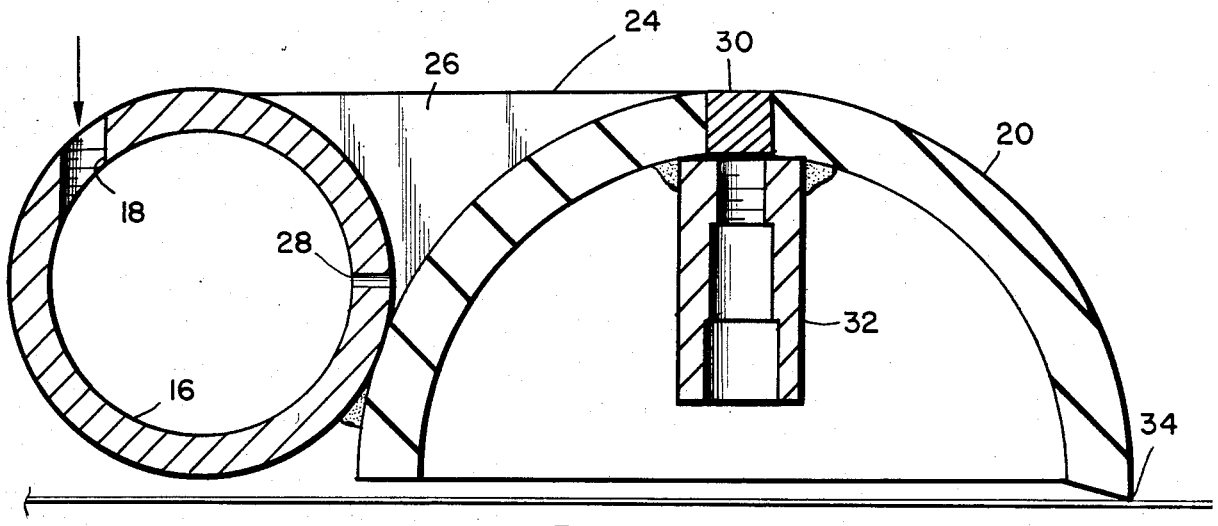
Fig. 2
Fig. 3
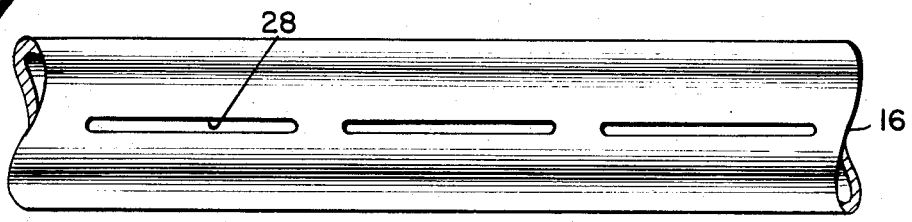
Fig. 4
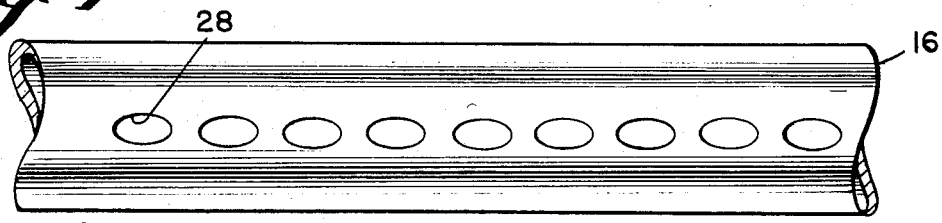

APPARATUS FOR UNIFORMLY APPLYING EITHER LIQUID OR FOAM COMPOSITIONS TO A MOVING WEB

BACKGROUND OF THE INVENTION

The present invention is directed to apparatus for uniformly applying either liquid or foam compositions to a moving web.

In copending U.S. patent application Ser. No. 390,114, filed on June 18, 1982, now U.S. Pat. No. 4,398,665, there is disclosed an arrangement for applying either liquids or foam to a moving web. That invention provides a trough into which the liquid or foam is directed. A curved blade is located on the opposite side of the trough. When the trough fills, the excess fluid flows over the crest of the blade and is uniformly deposited onto the web as it passes by the edge of the blade.

The arrangement described in Ser. No. 390,114 is particularly suited for use in applications such as dyeing wide lengths of carpet which require a substantial volume of liquid or foam to be available. The presence of a trough for the fluid material is desirable for such an application. On the other hand, when foam is the material being handled, an important consideration is its stability, i.e., its resistance to breakdown into liquid and air.

The stability of a foam is significantly affected by its age. While some foams are relatively stable, many others break down in very short periods of time. Accordingly, it is an objective of the present invention to provide an apparatus which can apply a foam to a moving web with minimum foam ageing and breakdown problems.

In U.S. Pat. No. 4,292,918 granted on Oct. 6, 1981, an apparatus is disclosed for applying liquid chemicals to a moving web in which a manifold covered with a sheath of porous material is positioned such that the sheath engages a curved blade. Liquid supplied to the manifold passes through the sheath and is directed onto the blade so as to flow as a film along the blade's surface and be deposited onto a web of material moving past an edge of the blade.

The apparatus disclosed in U.S. Pat. No. 4,292,918 is not suitable for applying foam to a web, however. This is because the porous sheath surrounding the manifold would prevent the foam from reaching the blade. Even if the porous sheath were not present, the particular arrangement by which fluid is directed to the manifold in U.S. Pat. No. 4,292,918 would fail to produce uniform distribution if foam were the fluid used. Such non-uniformity would cause the foam to unevenly age and break down. Furthermore, a uniform film of foam would not be obtained on the curved blade.

SUMMARY OF THE INVENTION

The present invention provides an apparatus which is useful in applications requiring limited quantities of fluids to be directed onto a moving web. It is particularly suitable where foam is the fluid which is to be uniformly applied to the web.

Briefly, a distributor is provided which dispenses either foam or liquid under pressure through a plurality of conduits to respective inlet ports spaced along the length of a manifold. The manifold comprises a pipe which contacts a curved blade along a line substantially parallel to, and below the elevation of, the crest of a horizontally disposed curved blade. The manifold is provided with an elongated outlet above the line of contact. As a result, foam or liquid discharged from the manifold builds up in a reservoir behind the blade's crest until it overflows the crest, causing a uniform film to move along the blade and be deposited onto a web moving past the edge of the blade.

DETAILS OF THE INVENTION

The invention will be described in greater detail with respect to the accompanying drawings wherein:

FIG. 2 is a view in section illustrating the interrelationship between a manifold and a curved blade which form the principal components of the applicator;

FIG. 3 is a fragmented elevational view of one embodiment of a manifold suitable for use as a component of the invention; and FIG. 4 is a fragmented elevational view of an alternative embodiment of a manifold.

Figure 1:
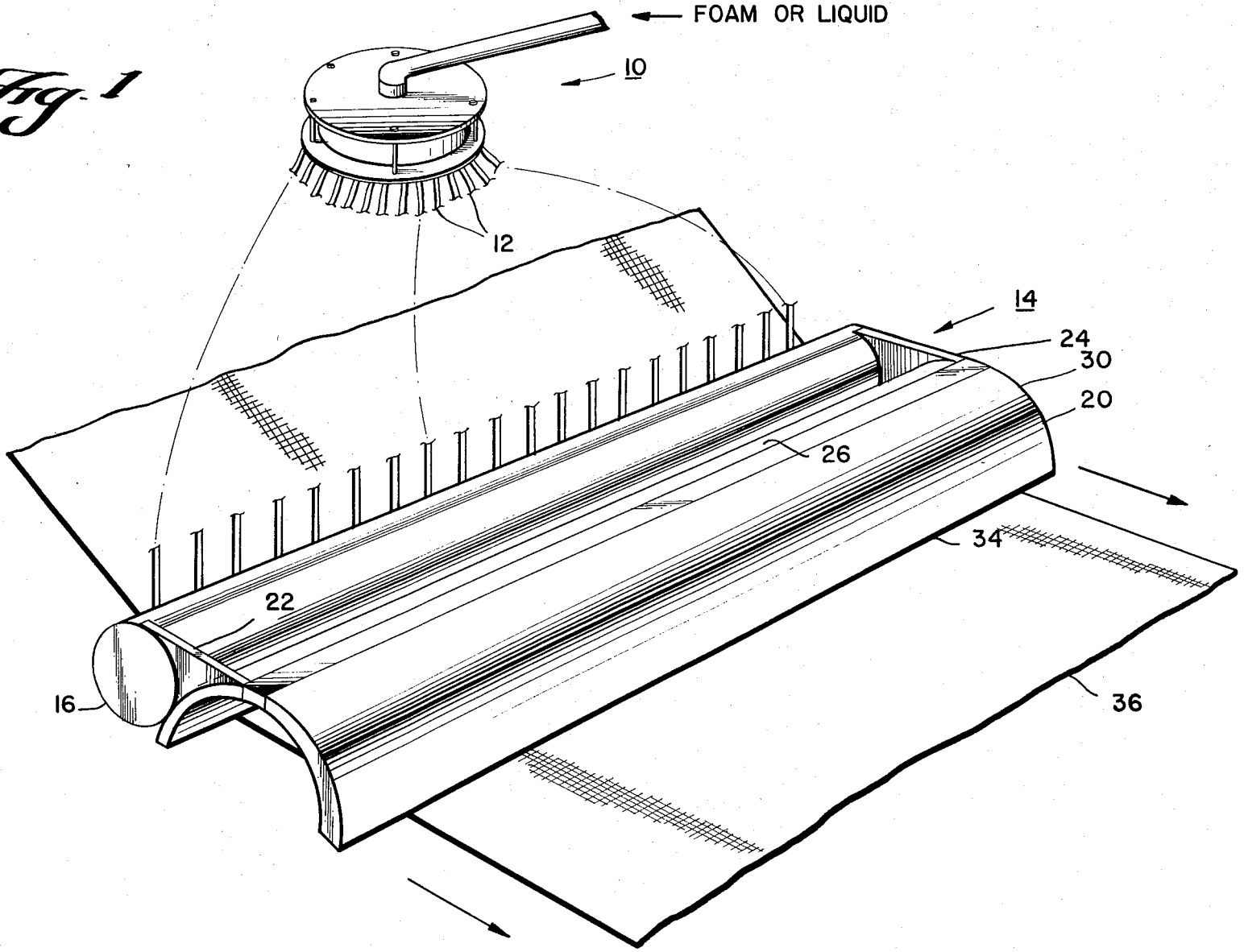
FIG. 1 is a perspective view of an applicator arrangement according to the invention.

Although the present invention is suitable for applying a uniform coating of either liquid or foam to a moving web, the following discussion will be directed primarily to its use in depositing foam onto the web.

Referring to FIG. 1, foam is directed under pressure to a distributor 10 from a conventional foamer (not shown). The details of distributor 10 are disclosed in the aforesaid copending application Ser. No. 390,114. For purposes of the present application, however, it is sufficient to note that the distributor 10 is provided with a plurality of output conduits 12 which direct the pressurized foam to an applicator 14.

The assembly of components which comprise the applicator can be appreciated by reference to FIGS. 1 and 2. More particularly, applicator 14 includes a manifold 16 which constitutes a pipe which is closed at its ends. The manifold includes a plurality of inlet ports comprising apertures 18 which are evenly spaced along the length of the manifold. Preferably, the axes of these apertures are normal to the direction of the longitudinal axis of the manifold 16, but are offset with respect thereto, so as to be located close to the interior wall of the manifold. Each aperture 18 is connected to a respective conduit 12 from distributor 10. Accordingly, when streams of foam under pressure are directed to applicator 14 via the conduits, the foam is uniformly distributed over the entire length of the manifold 16. Furthermore, due to the positioning of the apertures 18, the entry of the foam to the manifold is substantially tangential to its interior contour, thereby generating a vortex. This produces an even mixing of the foam throughout the length of the manifold and eliminates dead spots which could result in undesirable foam ageing and breakdown.

A curved blade 20 is provided which preferably comprises a longitudinal section of a cylinder. The manifold 16 is positioned in engagement with the blade 20 along a line which is located below the crest of the blade when the latter is substantially horizontally disposed. At opposite ends of the manifold-curved blade assembly, plates 22 and 24 are provided to define a reservoir 26 above the line of contact between the manifold and the blade. The manifold is provided with a plurality of openings 28 which connect the interior of the manifold with reservoir 26. As can be appreciated from FIGS. 3 and 4, these openings may take the form of elongated slots or a series of circular or elliptical apertures.

At its crest, the curved blade 20 is provided with a separate element 30 which extends the length of the blade. The element 30 is provided with a flattened upper surface which is movable with respect to blade 20. A plurality of mounts 32 are disposed on the underside of blade 20 at spaced locations along the blade beneath element 30. These mounts serve to support suitable leveling screws (not shown) which are brought into engagement with the underside of element 30 so as to position the upper surface of the element in a horizontal plane.

As foam passes through the openings 28, the reservoir 26 is uniformly filled along its length until the foam overflows the reservoir to move in a thin uniform film across the flat surface of element 30 and along the curvature of blade 20 to its edge 34. As a web 36 of suitable material is passed by edge 34, the foam is uniformly deposited on the web.

Although the arrangement has been described in connection with the application of foam to a moving web, it is apparent that the same apparatus also is capable of use in a system where the fluid supplied is a liquid one and is, in fact, a preferred method of application when a liquid system exhibits thixotropic characteristics. In such a case, distributor 10 will direct liquid via conduits 12 and manifold 16 to the reservoir 26, and overflow from the reservoir will be deposited onto the moving web via curved blade 20 in the same manner as described with respect to foam.

What is claimed is:

1. Apparatus for applying liquid and foam compositions to a moving web, including:

a manifold comprising a pipe having a plurality of inlet ports spaced along its length for receiving said composition, said inlet ports having axes normal to the direction of the axis of the manifold, but offset with respect thereto, whereby movement of said composition as it is received in the manifold is in a vortex;

a curved blade oriented so as to have a crest extending in a substantially horizontal line, said blade terminating in a straight edge on one side of the crest and contacting the manifold along a line parallel to, and below the level of, said horizontal line on the opposite side of the crest;

means for defining a reservoir between said manifold and the curved blade above the line of contact therebetween; and outlet means in the manifold for uniformly discharging said composition from the manifold into the reservoir to cause the reservoir to fill and overflow whereby said composition passes over the crest of the blade and moves as a uniform film along the blade to its edge for deposit onto the web as it moves past said edge.

2. Apparatus as set forth in, claim 1, wherein said outlet means comprises a plurality of aligned openings located on the opposite side of the axis of said manifold from said inlet ports.

3. Apparatus as set forth in either of claims 1 and 2, wherein said reservoir-defining means comprises plates extending between said manifold and the curved blade at opposite ends of said outlet means.

4. Apparatus as set forth in either of claims 1, and 2, wherein said curved blade at its crest includes an elongated element having a flattened upper surface, said element being adjustable with respect to the remainder of the blade such that the flattened surface can be horizontally leveled.

5. Apparatus as set forth in claim 4, wherein said reservoir-defining means comprises plates extending between said manifold and the curved blade at the opposite ends of said outlet means.

* * * * *